United States Patent [19]

Song

[11] Patent Number: 5,051,013

[45] Date of Patent: Sep. 24, 1991

[54] MASKING FILM

[76] Inventor: Albert C. Song, 125 Sunflower Ave., Stratford, Conn. 06497

[21] Appl. No.: 397,868

[22] Filed: Aug. 24, 1989

[51] Int. Cl.[5] ..... B41J 17/00

[52] U.S. Cl. ..... 400/498; 400/248

[58] Field of Search ..... 400/498, 504, 518.3, 400/519.7, 497, 713, 645.1, 248; 282/3 R, 5, 15 B, 19 B, 20 B, 21 C, 21 D; 281/2, 5, 8

[56] References Cited

U.S. PATENT DOCUMENTS

| | | | |
|---|---|---|---|
| 1,448,601 | 3/1923 | Smith . | |
| 1,454,821 | 5/1923 | Sherman et al. | 400/498 |
| 1,646,936 | 10/1927 | Smith . | |
| 1,713,163 | 5/1929 | Baskerville | 282/5 |
| 1,964,677 | 6/1934 | Schroeder | 282/15 B |
| 2,052,583 | 9/1936 | Sherman . | |
| 2,172,913 | 9/1939 | Rose | 282/21 C |
| 3,143,063 | 8/1964 | Stark | 400/713 |
| 3,788,536 | 1/1974 | Brown | 281/2 |
| 4,123,087 | 10/1978 | Baron . | |
| 4,311,401 | 1/1982 | Hiki et al. | 400/248 |
| 4,444,522 | 4/1984 | Suzuki et al. | 400/247 |
| 4,497,588 | 2/1985 | Volke et al. | 400/645.1 |
| 4,529,227 | 7/1985 | Fields . | |
| 4,571,102 | 2/1986 | Ono et al. | 400/248 |
| 4,636,099 | 6/1987 | Goldstone . | |

*Primary Examiner*—Eugene H. Eickholt

*Attorney, Agent, or Firm*—Bachman & LaPointe

[57] ABSTRACT

The present invention relates to an improved system for processing continuous multi-carboned paper stock material in which a plastic overlay material is used to prevent unwanted printings on a face of the material being printed. The overlay material comprises an endless loop of material having sprocket holes along two edges and a plurality of print impression holes. The print impression holes are spaced apart by a distance substantially equal to the pitch of the stock material. The overlay material is advanced together with the stock material during printing.

14 Claims, 1 Drawing Sheet

MASKING FILM

BACKGROUND OF THE INVENTION

The present invention relates to an improved system for processing continuous multi-carboned paper stock material such as mailing pieces. The system utilizes an endless masking film belt overlay having strategically positioned slots or holes to mask unwanted printings on an outermost face of the stock material.

A variety of systems have been used over the years to produce multiple copies of documents using a single printing device. Some of the earliest systems utilized with typewriters are shown in U.S. Pat. Nos. 1,448,601 and 1,646,936 both to Smith. The Smith patents relate to tally strip mechanisms used as part of a bookeeping system. The '601 patent relates to a mechanism for use with a typewriter in which separate rolls are provided for the tally strip and the carbon strip. After passing around the platen, the two strips are wound onto a common receiving roll. A work-sheet to be printed is passed around the platen outside of the carbon strip. Printing is effected in the usual manner with a carbon copy being produced on the tally sheet. The '936 patent illustrates a system in which a tally sheet is fed into the typewriter along with a ledger sheet.

U.S. Pat. No. 2,052,583 to Sherman illustrates a typewriter having a manifolding apparatus for repetitiously employing short length carbon sheets with continuous multi-form stationaery. The carbon sheets are interleaved between sheets of the stationery and have a plurality of holes which register with a series of holes in the stationery sheets. Feed pins associated with the platen simultaneously advance the stationery sheets and the carbon paper. After completion of the writing operation, the carbon sheets are held stationary while the printed stationery sheets are advanced to a tear-off position.

In modern times, multi-carboned stationery pieces such as mailing pieces are produced using a so-called "fly sheet". A printer such as an impact printer prints information, for example, services rendered, amount due, credit status, name and address of the recipient, etc. on the fly sheet. The back of the fly sheet is strategically carboned so that when it is stripped off only certain information, such as the name and address of the recipient, is visible on the top sheet. Other printed information is thus masked from the top sheet while printed on underlying sheets.

The fly sheets, while advantageous because a carbon ribbon is not required, have certain disadvantages. The first disadvantage is purely economic—the additional cost associated with the specially carboned fly sheet.

The second disadvantage has to do with the labor required during stripping and disposal of the fly sheet. The fly sheet typically has to be manually stripped causing additional economic expense and additional manual handling of the printed material. A further disadvantage is the poor quality printed material frequently obtained using fly sheets.

Accordingly it is an object of the present invention to provide a more economic system and process for printing multi-carboned stock material.

It is a further object of the present invention to provide a system and process as above for printing multi-carboned paper stock material which reduces the amount of labor associated therewith.

It is a further object of the present invention to provide a process and system as above for printing multi-carboned paper stock material which is relatively simple to use.

These and further objects and advantages will become more apparent from the following description and drawings in which like reference numerals depict like elements.

SUMMARY OF THE INVENTION

The foregoing objects and advantages are obtained through the use of an endless masking film loop overlay for preventing unwanted printings on a face of multi-carboned paper stock material. The masking film is formed by a plastic overlay material having a plurality of sprocket holes along two opposed edges and a plurality of print impression holes through which printing may be effected. The print impression holes in the masking film are spaced by a distance substantially equal to the pitch of the paper stock so as to be always properly positioned. In use, the masking film is advanced with the paper stock by appropriate tractor feed, sprockets or pin feed mechanisms.

The masking film overlay of the present invention is particularly advantageous in that it eliminates at least one layer of paper through which printing must be effected. Additionally, there is one less layer of paper stock to separate after printing has been completed.

The masking film of the present invention is further advantageous in that it may be used with a wide variety of standard printers. Still further, the endless masking film loop of the present invention can be used during numerous printings of paper stock. Still further, the masking film of the present invention facilitates a more legible printing of information on the outermost surface of the multi-carboned paper stock.

As previously mentioned, the masking film of the present invention may be used in conjuction with a wide variety of printers. Typically, the masking film overlay of the present invention lies between an inked carbon ribbon and a character set band drum. Suitable guide means are provided on the printer for guiding the masking film overlay in a substantially synchronous manner with the stock material to be printed. The guide means preferably includes suitable devices for keeping the masking film overlay taut. The guide means may be permanently mounted to the printer or removably mounted thereto. In order to reduce the cost, the guide means may be formed from a relatively thin, lightweight plastic material.

In operation, the masking film overlay is initially fed through the printer and the guide means until the lead portion of the film overlaps the trailing portion of the film. The lead portion and the trailing portion are then adhesively secured together in an appropriate manner to form the endless loop of masking film. Thereafter, the film is aligned with the stock material so as to permit printing on the outermost layer only in desired location(s). As each piece of stock material advances through the printer, the endless masking film loop is advanced.

DETAILED DESCRIPTION

Figure 1:
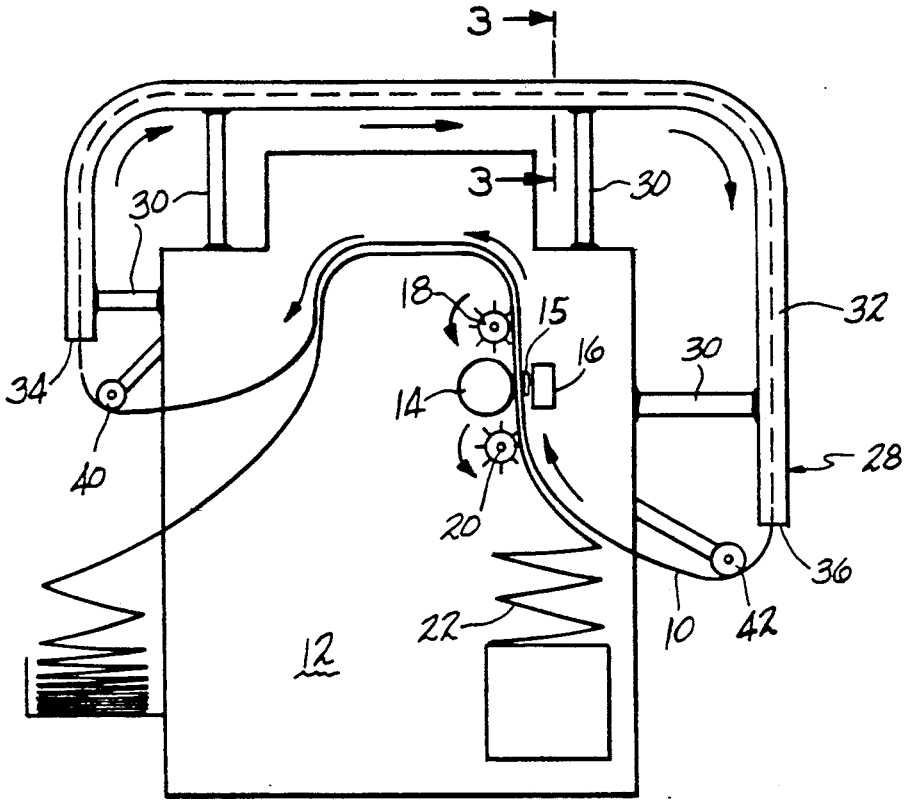
FIG. 1 is a side view of a printer with the endless masking film loop overlay of the present invention.

As shown in FIG. 1, the present invention comprises a printer 12 having a masking film overlay 11 intermediate the material to be printed and a portion of the printing assembly. The overlay 10 is formed by an endless loop of masking film 11.

The printer 12 may comprise any conventional non-laser printer known in the art. For example, the printer 12 may be an impact printer of the daisy wheel, dot matrix or drum type.

FIG. 1 schematically illustrates a printer having a drum wheel 14 with characters and a print wheel assembly 16 including a hammer assembly not shown. The hammer assembly may comprise a series of hammer heads, spaced about one tenth of an inch in width, rady to strike whenever a desired character comes into a print position. A carboned ribbon 15 is positioned in front of the print wheel assembly 16.

The printer 12 further includes sprocket wheels or pin feed mechanisms 18 and 20 for advancing the masking film overlay 10 and a multi-carboned paper stock material 22. When the printer 12 is a high speed printer, two sets of sprockets, one set at the top and another set at the bottom, pull the paper stock and the film upward at a predetermined speed. Any suitable motor means not known in the art may be used to operate the sprocket wheel sets at the predetermined speed.

The endless belt 10 of a masking film is preferably formed from a plastic material 11 such as MYLAR. The film 11 may have any desired thickness and width. A thickness in the range of from about 1 to about 4 mils is preferred. The width of the film is typically that of the stock material being printed complete with the carrier strips.

Figure 2:
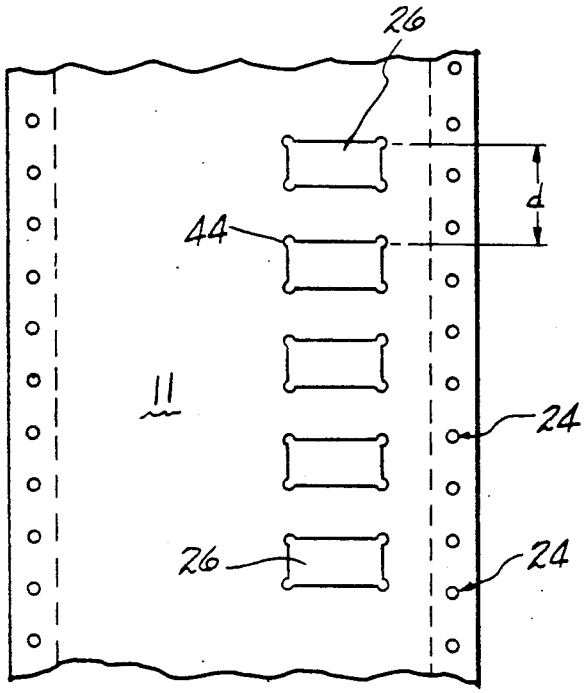
FIG. 2 is a schematic representation of a portion of the masking film of the present invention.

As can be seen from FIG. 2, a series of sprocket holes 24 are formed along two opposed edges of the film in the form of carrier strips. The sprocket holes 24 may be spaced at any desired interval.

The masking film 11 further includes a series of print impression holes or slots 26 cut within the plastic material. The holes 26 may have any desired width or height. The dimensions of the holes are determined by the extent of the material to be printed on the outermost face of the paper stock. The film 11 may be provided with pre-cut holes or alternatively without any holes. In the latter situation, it is up to the user to determine both the location and size of the holes 26. A cutting press may be used to cut the holes in the plastic material.

If desired, the holes 26 may be provided with suitable means 44 for alleviating stress concentrations at the corners of the holes. These stress relief means may comprise a series of rounded edges at the four corners of the hole. To form such print impression holes 26, a series of round holes may first be punched in the film material. Thereafter, a cutting press may be used to form the desired holes.

In a preferred embodiment of the present invention, the holes 26 are cut in the film 11 with a distance "d" between the uppermost edge of one hole and the uppermost edge of the next adjacent hole substantially equal to the pitch of the paper stock. As used herein the term "pitch" means the distance between the top of a first sheet of stock material and the top of the next sheet. It is important that the distance between adjacent print impression holes be substantially equal to the pitch to insure that printing occurs only in desired locations on the paper stock.

The masking film 11 of the present invention may be provided in any desired length, usually about 10 feet. In order to form the endless belt 10, the leading edge and trailing edges of the film 11 are secured together. Any suitable bonding material known in the art such as an adhesive or an adhesive tape strong enough to last one million rotations may be used to secure the edges together.

As shown in FIG. 1, the printer 12 is provided with means 28 for guiding the endless masking film loop overlay 10 in a desired manner. The guide means 28 may be permanently secured to the printing housing by strategically placed supports 30. Alternatively, the guide means 28 and/or the supports 30 may be removably affixed to the printer housing.

Figure 3:
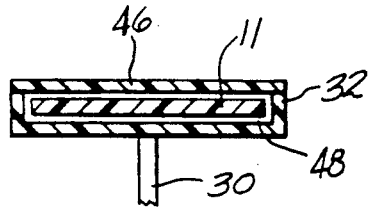
FIG. 3 is a cross sectional view of a first embodiment of a guide means mounted to a printer.

The guide means 28 may be formed from any suitable material known in the art. Translucent plastic materials are preferred, however, so as to minimize the weight of the guide means. As shown in FIG. 3, the guide means may comprise a housing 32 having a rectangular cross sectional shape which completely surrounds the masking film 11. The housing 32 has an inlet 34 and an outlet 36 through which the masking film material enters and exits the housing. If desired, the top portion 46 of the housing may be removable in order to have access to the film 11 in the guide channel 48. Suitable velcro retainers not shown may be used to hold the removable top portion 46 to the rest of the housing. In a preferred embodiment, the housing 32 forms a guide channel 48 which is approximately one quarter of an inch larger than the thickness of the film.

Figure 4:
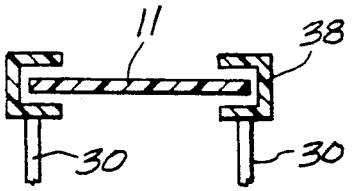
FIG. 4 is a cross sectional view of an alternative embodiment of an endless film guide means.

FIG. 4 shows an alternative embodiment of the guide means 28. As shown therein the guide means comprises two substantially U-shaped rails 38. The U-shaped rails define a guide path along which the masking film 11 travels. The rails are preferably formed from a lightweight material such as a plastic material and are supported on the printer by supports 30.

During operation, the endless belt of masking film material must be kept under a slight tension to prevent the film 11 from getting caught by the paper stock. To this end, guide wheels 40 and 42 are provided adjacent the inlet 34 and outlet 36 of the guide means. The guide wheels 40 and 42 may be plastic wheels and may be mounted to the printer housing in any desired conventional manner known in the art. The guide wheels in addition to providing tension serve to insure proper entry and exit of the masking film with respect to the guide means 28.

To use the masking film system of the present invention, the leading edge of the film 11 is inserted into the printer generally between the inked carbon ribbon 15 and the character set band drum 14. The film is then advanced until the leading edge exits the guide means 38 and overlaps the trailing edge portion of the film. The film loop 10 is formed by applying an adhesive to one or more of the edges and securing them together. If necessary, the film 11 may be trimmed prior to bonding. Thereafter, the paper stock is fed into the printer in the usual manner using the sprocket wheel assemblies. Prior to printing, the film is aligned on the sprocket wheel assemblies so that a first one of the print impression holes 26 is set in a desired print location with respect to the first piece to be printed. After the sprocket holes of the film loop 10 are positioned in the sprocket assemblies, the film 11 will advance with the paper stock.

As previously discussed, the masking film of the present invention prevents unwanted information from being printed on the outermost layer of the paper stock. The only information which can be printed on this layer is through the print impression hole. All other information is printed on the film.

The scheme of the present invention completely eliminates the need for a fly sheet, subsequent stripping of the fly sheet, and disposal thereof. In addition to the reduction in labor required to handle the printed material, the masking film of the present invention provides a significant economic benefit in that it may be used in numerous printings. Should the masking film become torn or unusable for some other reason, it can be easily removed merely by cutting the belt and advancing the film until the trailing edge no longer engages the sprocket wheel assemblies.

While it is preferred to use MYLAR for the masking film, other suitable durable materials may be used instead.

While it is preferred to provide the guide means 28 of FIG. 3 with a removable top, it could be provided instead with a removable side portion for facilitating insertion of the film belt.

The present invention has particular utility in the printing of multi-carboned mailing pieces in which the outermost layer is an envelope.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A masking film overlay for preventing unwanted printings on a face of multi-carboned paper stock material having a desired pitch which comprises:

a substantially planar piece of material suitable for placement over said face; and said material being formed as an endless belt of material and having a plurality of sprocket holes along two opposed edges for enabling it to be advanced with the stock material being printed.

2. A masking film overlay according to claim 1 which further comprises at least one print impression hole in said material through which said face may be imprinted.

3. A masking film overlay according to claim 1 which further comprises:

a plurality of print impression holes in said material; and said impression holes being spaced by a distance substantially equal to the pitch of said stock material.

4. A masking film overlay according to claim 3 wherein each said impression hole has a substantially rectangular shape and means for relieving stress concentrations at its corners.

5. A masking film overlay according to claim 1 wherein said overlay is formed from a plastic material having a thickness in the range of from about 1 mil to about 4 mils.

6. A system for printing multi-carboned stock material which comprises:

a printer having means for printing a desired set of indicia on said stock material;

an endless masking film overlay intermediate a portion of said printing means and a face of said stock material being printed for preventing printing on selected portions of said face, said stock material having a predetermined pitch; and sprocket means for simultaneously advancing said masking film overlay and said stock material.

7. A system according to claim 6 further comprising means for guiding said masking film overlay in a desired path mounted to said printer.

8. A system according to claim 7 further comprising: means for keeping said masking film overlay under tension.

9. A system according to claim 8 wherein said masking film overlay is formed by a plastic material.

10. A system according to claim 9 wherein said masking film overlay has a plurality of holes through which printing may be applied to said face.

11. A system according to claim 10 wherein:

each hole has an upper surface; and said upper surfaces of adjacent ones of said holes are spaced apart a distance substantially equal to the pitch of the stock material.

12. A system according to claim 11 wherein said guide means are removably mounted to said printer.

13. A system according to claim 12 wherein said guide means are formed by a housing having a rectangular cross section.

14. A system according to claim 13 wherein said guide means are formed by two substantially U-shaped rails.

* * * * *